United States Patent [19]

Courtin

[11] Patent Number: 4,590,926

[45] Date of Patent: May 27, 1986

[54] HAND-HELD MASSAGER

[76] Inventor: Olivier Courtin, 7, rue Guénégaud, 75006 Paris, France

[21] Appl. No.: 416,058

[22] Filed: Sep. 8, 1982

[30] Foreign Application Priority Data

Mar. 16, 1982 [FR] France ..... 82 04440

[51] Int. Cl.[4] ..... A61H 7/00

[52] U.S. Cl. ..... 128/67; 128/62 R; D24/41

[58] Field of Search ..... 128/54, 55, 60, 61, 128/62 R, 67, 68, 69; D24/41, 42, 64; 51/204, 391, 392, 393

[56] References Cited

U.S. PATENT DOCUMENTS

| | | | |
|---|---|---|---|
| D. 180,564 | 7/1957 | Nakamura | D24/42 |
| D. 247,312 | 2/1978 | Zeiss | D24/64 |
| D. 269,376 | 6/1983 | Nakao et al. | D24/41 |
| 923,158 | 6/1909 | Egan | 128/62 R |
| 1,769,872 | 7/1930 | Weeks | 128/60 |
| 1,965,861 | 7/1934 | Schneider | 128/62 R |
| 2,447,698 | 8/1948 | Haberer | 128/69 |
| 2,865,147 | 12/1958 | Grandemange | 51/204 |
| 2,970,592 | 2/1961 | David | 128/69 |

FOREIGN PATENT DOCUMENTS

| | | | |
|---|---|---|---|
| 2303544 | 8/1974 | Fed. Rep. of Germany | 128/60 |
| 636160 | 4/1928 | France | 128/62 R |
| 63985 | 10/1955 | France | 128/59 |
| 2020678 | 7/1970 | France | 128/24 R |
| 2083711 | 12/1971 | France | 128/58 |
| 2187284 | 1/1974 | France | 128/61 |
| 10702 | 9/1895 | Switzerland | 128/62 R |

*Primary Examiner*—Richard J. Apley
*Assistant Examiner*—David J. Brown
*Attorney, Agent, or Firm*—Kane, Dalsimer, Kane, Sullivan and Kurucz

[57] ABSTRACT

The massager (10) comprises a substantially parallelepiped shaped graspable body having a leading edge which includes a curved central notch (13) with a rounded projection (14, 15) on either side thereof. The curvature of the notch and of each of the projections is such that, when said leading edge of the massager is applied to the back of a person to be massaged, the two projections rest on either side of the spinal column in such a manner as to massage the paravertebral muscles in a manner identical to that provided by the thumbs of a masseur whose shape is imitated by the projections. The rear edge (16) is advantageously provided with a concave curve extending from one side of the massager to the other and suitably dimensioned for providing effective massage of the lower limbs.

11 Claims, 2 Drawing Figures

HAND-HELD MASSAGER

The present invention relates to a hand-held massager including means for massaging the paravertebral muscles.

BACKGROUND OF THE INVENTION

Kinesitnerapists currently perform such massaging by placing their thumbs on respective sides of the patient's spinal column and by applying equal pressure with both thumbs. The pressure may be of variable intensity.

Such massaging is not readily performed by a non-professional because of the difficulty in maintaining equal pressure on both thumbs while moving them along the spinal column.

The aim of the present invention is to provide a back massager which can be used efficiently, even by a non-professional.

Preferred embodiments of the invention also provide a massager whose back-massaging means are suitable for use in a massager which further includes means suitable for performing other types of massage.

SUMMARY OF THE INVENTION

The present invention provides a hand-held massager comprising a substantially parallelepiped shaped graspable body having a leading edge which includes a curved central notch with a rounded projection on either side, the curvature of the notch and of each of the projections being such that, when said leading edge of the massager is applied to the back of a person to be massaged, the two projections rest on either side of the spinal column in such a manner as to massage the paravertebral muscles in a manner identical to that provided by the thumbs of a masseur whose shape is immitated by the projections, said notch and projections independent of any massaging means that may be provided on other faces of the massager, eg. the bottom face.

The user can thus perform so-called "spinal column" massage on a person, simply by moving the massager. This is not tiring to do and the user remains assured that equal pressure is being exerted by the two projections in the manner of the thumbs of professional masseurs.

The rear edge of the massager, i.e. the edge at the opposite end to the front edge which is equipped with back massaging means, has a concave curve extending from one side of the massager to the other and suitably dimensioned for providing effective massage of the lower limbs.

Finally, the graspable body of the massager may also have a rough upper surface or back suitable for enabling the user to provide a pummice stone type of action, when required.

BRIEF DESCRIPTION OF THE DRAWINGS

An embodiment of the invention is described by way of example with reference to the accompanying drawing, in which.

MORE DETAILED DESCRIPTION

The massager comprises a graspable body 10 of roughly parallelepiped shape with its longer side faces

11 and 12 advantageously having a series of shallow depressions to facilitate grasping the device in the hand of a user.

A leading end edge of the massager has a central curved notch 13 flanked on either side by rounded projections 14 and 15 which merge in with the adjacent long side faces.

Figure 1:
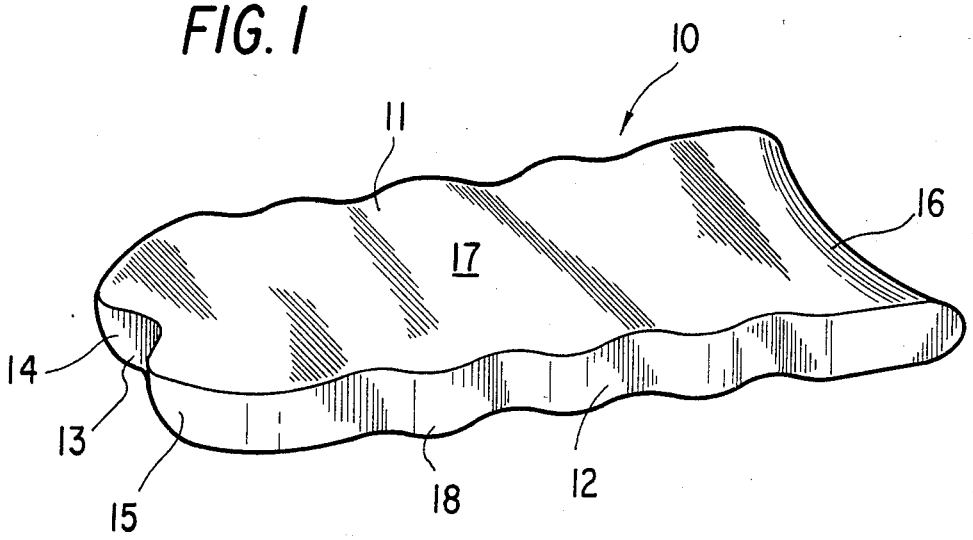
FIG. 1 is a perspective view of a massager in accordance with the invention.
Figure 2:
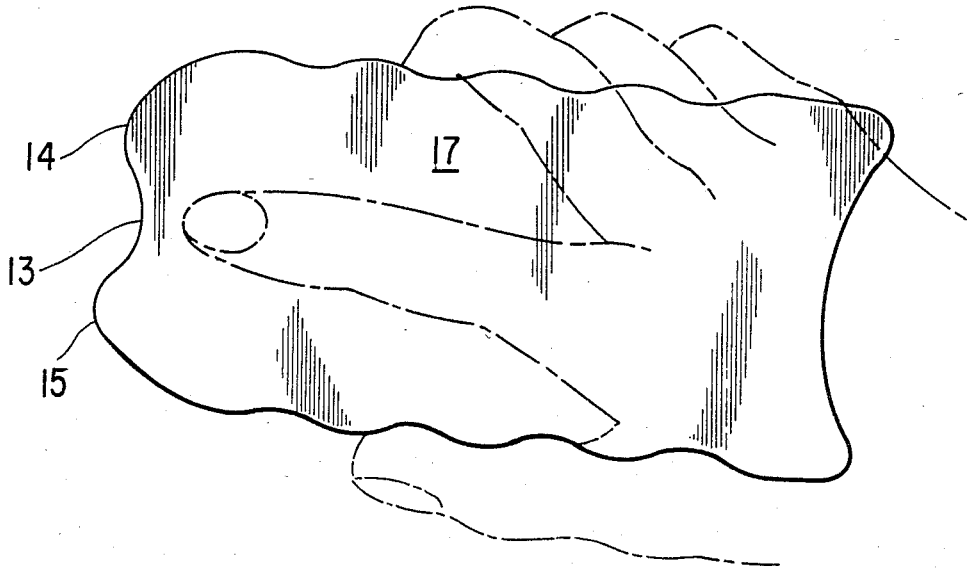
FIG. 2 is a plan view of the massager, seen through the hand of a user.

The curvature of the central notch 13 and of the projections 14 and 15 is chosen, as can be seen in the plan view of FIG. 2, in such a manner that when the edge of the massager is pressed against a person's spinal column, the bottom of the notch 13 presses against the projecting edges of the vertebrae while the projections 14 and 15 press against the paravertebral muscles on either side. Further, the projections 14 and 15 meet the top surface 17 of the massager (as held in use) following a much sharper curve than the curve by which they meet the bottom surface 18 of the massager. The shape of the projections thus approximates to the shape of a masseur's thumb.

To perform spinal column massage, the user holds the device in such a manner as to leave the front edge with its notch 13 and its projections 14 and 15 projecting freely in front of the hand holding the massager (see FIG. 2). The device is then moved along the spinal column. Regular pressure can be applied equally by both projections 14 and 15 in the manner of the thumbs of a professional masseur without tiring the user.

The opposite end edge 16 of the graspable body of the massager is advantageously provided with a concave curve extending from one side to the other of said edge. The curve is dimensioned to provide effective massaging of the lower limbs, with both upper and lower edges of the curve 16 meeting the adjacent top and bottom surfaces of the massager via curves of the same radius of curvature.

The massager may be used to in a massage operation that requires simultaneous application of a balsam, while avoiding the need for the balsam to be applied manually which can sometimes be disagreeable.

For this purpose, the massager is best made of a material that is easy to clean, and in particular a plastic material.

The back 17 of the graspable body of the massager (see FIG. 2) may be provided with a rough surface enabling the user to rub and polish the skin in a manner similar to that which can be obtained using pummice stone.

The invention is applicable to any hand held massager having a graspable body independently of main massaging means that may be provided on the bottom face 18. Such means may comprise, for example, a row of inclined blades as described in my pending U.S. patent application Ser. No. 328,677 filed on Dec. 8, 1981.

I claim:

1. A hand-held massager comprising a substantially parallelepiped shaped graspable body having a leading edge on a forward face thereof which includes a continuous curved central notch leading to a rounded thumb-spaced projection on either side said thumb-shaped projections being convex in plan view and spaced at a distance equal to a spinal column, the notch and the projections being arranged and constructed with curvatures conforming to the shape of a spinal column such that, when said leading edge of the massager is applied to the back of a person to be massaged, the two projections rest on either side of the spinal column in such a manner as to massage the paravertebral muscles in a manner identical to that provided by the thumbs of a masseur as the massager is moved along the spinal column.

2. A massager according to claim 1, wherein said graspable body has upper and lower faces and the projections have upper and lower curves of different radii of curvature extending toward said upper and lower faces, respectively, the upper curve being of substantially smaller radius of curvature than the lower curve.

3. A massager according to claim 1, wherein said graspable body has a rear edge opposite to said leading edge which is equipped with back massaging means, said rear edge has a concave curve extending from one side of the massager to the other and suitably dimensioned for providing effective massage of the lower limbs.

4. A massager according to claim 3, wherein said rear edge is connected to the upper and lower faces of the graspable body by concave curves of equal radius of curvature.

5. A massager according to claim 1, wherein the graspable body of the massage said upper face has a rough texture suitable for polishing the skin in the manner of a pumice stone.

6. A massager according to claim 1 made of plastic.

7. A hand-held massager comprising a substantially parallelepiped shaped graspable body having a leading edge on a forward face thereof which includes a continuous curved central notch leading to a rounded, thumb-shaped projection on either side said thumb-shaped projection being convex in plan view and the notch and the projections being arranged such that, when said leading edge of the massager is applied to the back of a person to be massaged, the two projections rest on either side of the spinal column in such a manner as to massage the paravertebral muscles in a manner identical to that provided by the thumbs of a masseur as the massager is moved along the spinal column.

8. A hand-held massager comprising a substantially parallelepiped shaped graspable body having a leading edge which includes a curved central notch with a rounded, thumb-shaped projection on either side spaced at a distance equal to a spinal column, the notch and the projections being arranged and constructed with curvatures conforming to the shape of a spinal column such that, when said leading edge of the massager is applied to the back of a person to be massaged, the two projections rest on either side of the spinal column in such a manner as to massage the paravertebral muscles in a manner identical to that provided by the thumbs of a masseur as the massager is moved along the spinal column and wherein said graspable body has upper and lower faces and the projections have upper and lower curves of different radii of curvature extending toward said upper and lower faces respectively, the upper curve being of substantially smaller radius of curvature than the lower curve.

9. Massager, designed for back-massaging, comprising a substantially parallelepiped plate having two flat main faces, two lateral faces and two end faces, respectively front and back, and in which the front end face is curved in a contour having two projections which are convex in plan view which are respectively connected to the lateral faces, each projection having the shape of a thumb and framing a central concave part, the massager being adapted to be hand-grasped at its longitudinal lateral faces in order to move the plate along a person's back with the thumb-shaped convex parts on both sides of the spine to effect massage of the paravertebral muscles.

10. Massager according to claim 9, in which the lateral faces have undulations for gripping.

11. Massager according to claim 9, in which the projections of the front end face are connected to a main face by a curve.

* * * * *